United States Patent [19]

Schulz

[11] 4,361,928

[45] Dec. 7, 1982

[54] MUFFLED EXHAUST SYSTEM FOR HOT WATER VACUUM EXTRACTION MACHINE

[75] Inventor: Rainer R. Schulz, Sparks, Nev.

[73] Assignee: Parise & Sons, Inc., Sparks, Nev.

[21] Appl. No.: 279,386

[22] Filed: Jul. 1, 1981

[51] Int. Cl.[3] ..... A47L 9/00

[52] U.S. Cl. ..... 15/326; 15/413; 417/312

[58] Field of Search ..... 15/321, 320, 326, 353, 15/413; 415/119; 417/312; 55/276

[56] References Cited

U.S. PATENT DOCUMENTS

| | | | |
|---|---|---|---|
| 2,884,185 | 4/1959 | Dolan | 15/326 X |
| 3,831,223 | 8/1974 | Colt et al. | 15/326 X |
| 4,195,969 | 4/1980 | Whitney | 417/312 X |
| 4,288,885 | 9/1981 | Parise | 15/413 X |
| 4,330,899 | 5/1982 | Miller et al. | 15/326 |
| 4,334,337 | 6/1982 | Miller et al. | 15/326 |

*Primary Examiner*—Chris K. Moore

*Attorney, Agent, or Firm*—Sughrue, Mion, Zinn, Macpeak & Seas

[57] ABSTRACT

A unitary tubular exhaust duct directs exhaust air from a scroll type outlet for a vacuum pump mounted within a hot water vacuum extraction machine into a baffled exhaust expansion chamber. Noise reduction is accomplished by mixing the exhaust air with the motor cooling air aspirated into the expansion chamber by an exhaust duct branch terminating at its end remote from the exhaust expansion chamber in a cylindrical shroud which surrounds the vacuum pump electrical drive motor casing and the area of the cooling air exhaust holes within that motor casing.

5 Claims, 2 Drawing Figures

FIG. 1
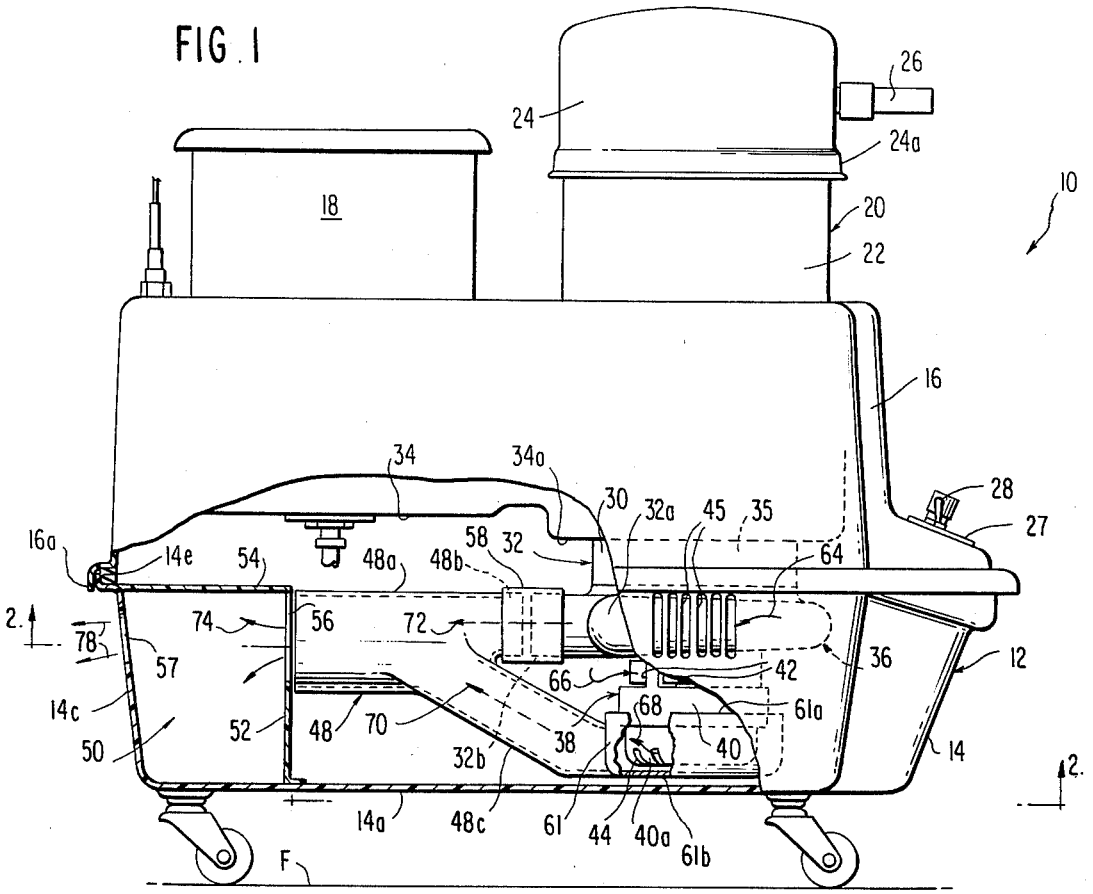
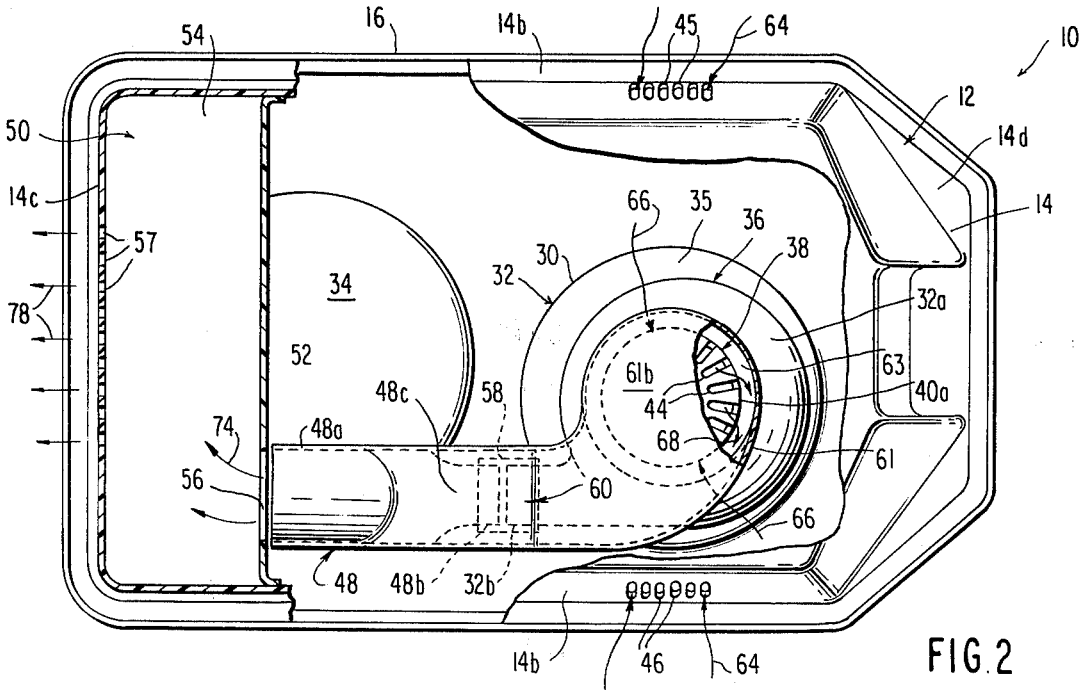
FIG. 2

MUFFLED EXHAUST SYSTEM FOR HOT WATER VACUUM EXTRACTION MACHINE

FIELD OF THE INVENTION

This invention relates to hot water vacuum extraction machines, and more particularly, to an improved exhaust system in which the noise level of the cleaner is reduced without a corresponding reduction in performance.

BACKGROUND OF THE INVENTION

Small hot water vacuum extraction machines have come into recent vogue and are employable by the housewife for rug cleaning. Large hot water vacuum extraction machines have been commercially employed for many years under the general term "steam cleaners". The steam cleaners employ a source of very hot water which is sprayed by means of a nozzle mounted to the rear of a vacuum extraction head borne at the lower end of a tubular wand carried by the operator. The tubular wand is hose connected to a dirty water accumulation tank within the steam cleaner chassis. A narrow slot within the vacuum head is subject to vacuum pressure, through the wand and hose, such that, the dirty water adjacent the area of impact of the hot water jetted from the nozzle onto the underlying rug to be cleaned, is sucked up and returned to the machine or to a corresponding dumping mechanism. Such commercial machines are complex and, in many cases, the source of hot water and the sump tank were carried by a motor vehicle such as a truck, requiring long hose connections leading to the interior of the home being cleaned.

A number of patents have issued in recent years to Parise and Sons, Inc., the common corporate assignee of the present application, directed small hot water vacuum machines capable of operation by a housewife and directed to that market. Representative patents are:

| | |
|---|---|
| 3,896,521 | HOME CLEANING SYSTEM |
| 3,911,524 | STEAM CLEANER DUMP BUCKET |
| 4,009,728 | WATER VALVE ASSEMBLY |
| 4,015,589 | STEAM CLEANER PROTECTION SCREEN |
| 4,046,989 | HOT WATER EXTRACTION UNIT HAVING ELECTRICAL IMMERSION HEATER |
| 4,075,733 | CLEANING HEAD |
| 4,078,908 | DUMP BUCKET FOR A WET-DRY VACUUM SYSTEM HAVING IMPROVED LIQUID FLOW CHARACTERISTICS |
| 4,083,705 | DUMP BUCKET FOR A WET/DRY VACUUM SYSTEM |
| 4,088,462 | HOT-WATER EXTRACTION UNIT |
| 4,122,579 | STEAM CLEANER DUMP BUCKET |

Most of the hot water vacuum extraction machines developed by Parise and Sons, Inc. are characterized by a plastic casing or housing of modified parallelepiped form, which bears separately a hot water supply tank and a removable dump tank. The dump tank receives the accumulated dirty water returned from the surface being cleaned by vacuum application through the dump tank, connecting hose, and wand to vacuum pick-up head.

Several major mechanical elements are carried internally of the casing to assist in these functions including an electric motor driven pump for pumping the hot water from the hot water supply tank to the spray nozzle borne by the vacuum head. Further, in order to create the vacuum pressure within the dump tank and also transmit it from the dump tank to the vacuum pick up head through the hose and wand leading thereto, an electric motor driven vacuum pump is also mounted within the casing. It underlies the removable dump tank in certain models. That component is formed of two major elements, the vacuum pump or blower and the electrical drive motor, coaxially mounted thereto. A suction fan or blower is shaft mounted within a vacuum pump casing and normally within a portion of a casing which takes a scroll form and which terminates in a tubular exhaust pipe leading tangentially away from the pump casing. The shaft bearing suction fan or blower is normally integral with the electrical motor rotor. The motor stator concentrically surrounds the rotor and is fixed to the motor casing, with that casing integrated to the vacuum pump casing itself. An air inlet to the vacuum pump is provided within the horizontal upper wall of the pump casing which underlies the lower end of the cylindrical dump tank and which communicates with a cylindrical riser tube within the dump tank lower section. The bottom of riser tube is sealed in communication, through the top horizontal wall of the vacuum pump casing with the plenum chamber. An inverted cup-shaped cover seals to the upwardly open top of the dump tank. A tubular coupling or connector projects radially outwardly from the side of the cover to make connection to a flexible hose which, in turn, leads to the vacuum wand and the vacuum head carried by that wand. Rotation of the suction fan or blower for the vacuum pump by the electrical drive motor creates a vacuum pressure within the dump tank, which vacuum is transmitted by the hose and wand to the vacuum head. Positive pressure air exhausts through the scroll portion of the vacuum pump casing and exits through the tubular end of the scroll. Normally, an elbow connected to the scroll tubular outlet is fixedly mounted to the interior of the extraction machine casing opens to the exterior of the casing through a hole within the bottom wall of the lower casing section.

In such prior art construction, there is a necessity to cool the electrical drive motor by permitting cooling air to be drawn into the motor casing interior by a second shaft mounted fan within the electric motor itself and at the end of the motor rotor remote from the vacuum pump blower section. The pitch of the cooling fan, its speed of rotation and the location of inlet and outlet holes within the electric motor casing insure forced passage of cooling air over the motor stator and rotor during vacuum pump operation. Slots are normally provided within the hot water vacuum extraction machines lower casing section at one point within the casing sidewall or bottom wall to allow cooling air to reach the motor while the heated air is permitted to exit from the interior of the casing after discharge from the electric motor casing itself via another set of casing sidewall or bottom wall slots. In order to accomplish this, shrouds, baffle plates or the like may be provided for directing a confined cooling air stream to and/or from the motor.

As may be appreciated, with the relatively high velocity positive air flow exiting from the scroll at the outlet side of the vacuum pump directly to the exterior of the machine casing, and with the cooling air flow from the electric drive motor also exiting directly to the machine exterior through openings within the sidewall or bottom wall of the machine casing, a relatively high noise level exists during operation of the machine. This is both due to the velocity of the air and the normal noise associated with the operation of electrical water pump drive motor and the vacuum pump drive motor, particularly the vacuum pump drive motor. Further, due to the confined nature of the cooling air flow and that of the exhaust air from the vacuum pump, such noise is attenuated.

It is, therefore, a primary object of the present invention to provide an improved hot water vacuum extraction machine in which the noise level of the cleaner is relatively low, and wherein the exhaust air from the vacuum pump and the cooling air passing through the vacuum pump drive motor is expanded prior to leaving the extraction machine casing, without loss of machine component performance.

SUMMARY OF THE INVENTION

The present invention is directed to a hot water vacuum extraction machine of the type including an imperforate casing of plastic or the like having a dump bucket mounted to the casing and a vacuum pump assembly fixedly carried by the casing and underlying the dump bucket. The vacuum pump assembly includes a pump casing defining a plenum chamber, a suction fan mounted for rotation within the vacuum pump casing, the plenum chamber including an air inlet in sealed fluid communication with the interior of the dump bucket. The vacuum pump assembly further includes an electric motor for driving the suction fan, the vacuum pump casing includes a scroll on the discharge side of the suction fan which terminates in a tubular exhaust pipe extending tangentially from the suction pump casing. The motor includes a cylindrical motor casing having cooling air inlets within one end of the motor casing and air outlet openings within the other end. Air inlet openings are provided within the machine casing to permit cooling air to circulate through the interior of the machine and to pass through the air inlet and air outlet openings of the motor casing for cooling the motor.

The improvement comprises a sound muffling and air expansion chamber within the casing and exhaust duct means coupled to the exhaust pipe and leading to the sound muffling and air expansion chamber. The duct means includes means for channeling cooling air discharging from the cooling air outlet openings of the motor casing for aspiration by the air discharging from the exhaust pipe into the sound muffling and air expansion chamber. Air outlets within the machine casing communicate to the interior of the sound muffling and air expansion chamber such that there is substantial reduction of noise level of the machine by mixing of the exhaust air with the vacuum pump air from the vacuum pump with the motor cooling air and expanding the same within the sound muffling and air expansion chamber prior to exhausting the air outwardly of the casing.

Preferably, a venturi is provided upstream of the connection between the main tubular duct of the exhaust duct means and a branch duct, the branch duct opening at the end remote from the main tubular duct to a large diameter shroud which surrounds the end of the electric drive motor for the pump bearing the cooling air outlet opening within the motor casing. Transverse vertical and horizontal baffle plates extending between the sidewalls of the machine casing form with a portion of the bottom wall and end wall of the same machine casing, the sound muffling and air expansion chamber. Air outlet holes for the chamber are provided within the lower casing section at a level well above the bottom of the lower casing section to prevent electrical shock in case of accidental placing of the casing in standing water.

BRIEF DESCRIPTION OF THE DRAWINGS

FIG. 1 is a side elevational view (partially broken away), of a hot water vacuum extraction machine employing the improved low noise air exhaust system forming a preferred embodiment of the present invention.

FIG. 2 is a sectional and bottom plan view (partially broken away) of the machine illustrated in FIG. 1 taken about line II—II.

DESCRIPTION OF THE PREFERRED EMBODIMENT

Referring to the drawings, the improved exhaust system of the present invention is employed in a hot water vacuum extraction machine illustrated generally at 10. The machine 10 includes a wheeled chassis or casing indicated generally at 12 and formed of a lower, upwardly open, modified parallelepiped plastic casing section 14 and a similarly configured downwardly open, upper casing section 16 fitted thereto by way of integral flanges 14*e* and 16*a*, respectively. The upper casing 16 is recessed within its top wall, so as to receive in upstanding fashion and side-by-side, a hot water supply tank 18 which may be formed of plastic, metal or the like and a cylindrical dump tank indicated generally at 20, tank 20 being is formed of a lower upwardly open cylindrical container 22 and an inverted cup shaped cylindrical cover 24. Cover 24 includes an integral flange 24*a* which seals to the uper open end of the dump tank container 22 in the manner of the aforementioned patents.

As may be appreciated, the cover 24 bears a radially projecting tubular connector as at 26 which projects through the cylindrical sidewall of the cover 24, is sealed thereto, and which connects to one end of a flexible hose (not shown) leading to a vacuum wand (not shown). The wand terminates at its lower end in a vacuum extraction or pick-up head (also not shown). Although not shown, the dump tank 20 includes internally a cylindrical riser tube at the center thereof which opens at its bottom through the bottom wall of the dump tank container 22 and which is in sealed communication with and axially aligned with an inlet opening of horizontal end wall 30 of vacuum pump casing 32, the vacuum pump being indicated generally at 36.

As may be appreciated, the upper machine casing section 16 bears a depressed internal wall 34 which is depressed, formed by a depression and within which seats the lower ends of the hot water supply tank 18 and container 22 of dump bucket 20. This interior wall includes a horizontal, flat bottom wall portion 34*a* which overlies and is in direct contact with the pump casing end wall 30. Aligned openings within the bottom of the dump tank container 22, bottom wall 34*a* of casing section 16 and pump casing end wall 30 permit communication between the interior of the pump casing 32, that is, at plenum chamber 35 formed by that casing at the inlet end of the vacuum pump and the interior of the dump tank 20. The pump casing 32 includes a portion 32*a* in the form of a scroll, the casing portion 32*a* terminating in a small diameter tubular exhaust pipe 32*b* which projects tangentially away from the pump casing 32. The vacuum pump 36 includes an electric drive motor indicated generally at 38, the motor including a cylindrical casing or housing 40 which may be integral with the vacuum pump casing 32, coaxial therewith, and function as an extension thereof. The casing 40 houses, internally, a stator which is fixedly mounted to the interior of the pump casing and which concentrically surrounds a rotor (neither shown), the rotor bearing integrally a shaft which projects from opposite ends thereof, the portion of the shaft within the scroll portion 32*a* of the vacuum pump casing 32 bearing the vacuum fan or blower to provide the desired vacuum pressure or suction acting through the dump tank 20 while the shaft portion which projects from the opposite end of the rotor bears a cooling fan blade (not shown) within motor casing end cap 40*a*, remote from the vacuum pump casing 32.

Further, the motor casing 40 is provided with a plurality of slots as at 42 about its periphery within which cooling air may enter for flowing over and about the rotor and stator and the windings thereon, the cooling air exiting through further slots 44 borne by end cap or end bell 40*a* of the motor, the cooling air flow being indicated by the arrows 66, 68, FIG. 1.

As described to this extent, the vacuum pump 36 is conventional. The cooling air for the motor both enters the interior of the lower machine casing section 14 via appropriate slots as at 45 within the sidewall of that casing section and exits from the interior of that casing section through slots as at 46 on the opposite side of that casing section, FIG. 2, in the prior art construction. However, to the extent of the improved muffled, exhaust system of the present invention, the slots 45 and 46 on opposite sidewalls of the lower casing section 14 of the machine, are both employed for air inlet purposes, feeding to the motor casing cooling air inlet slots 42.

Secondly, while under past constructions, an elbow or like tubular air duct is connected to the end of the positive pressure air exhaust pipe 32*b* at the terminal end of the scroll 32*a* of the pump casing, and wherein the opposite end of that elbow discharges the positive pressure air stream exterior of the casing through an opening within the bottom wall 14*a* of casing section 14, the present invention makes use of a unitary tubular exhaust duct member indicated generally at 48 which acts in conjunction with a specially formed sound muffling and air expansion chamber indicated generally at 50 to expand the air discharging from the vacuum pump, muffle that air flow prior to discharge from the machine casing, and to aspirate the cooling air flowing through the electric motor 36 into the primary air stream, thereby improving cooling of the motor and muffling the motor noise generated during machine operation.

In that respect, in addition to the casing section having a horizontal bottom wall 14*a*, it is provided with laterally opposed sidewalls as at 14*b*, and at opposite ends, end walls 14*c* and 14*d*, respectively. End wall 14*c*, at the rear of the machine, acts in conjunction with a specially formed vertical baffle plate as at 52, and a horizontal baffle plate 54 both of which span across the complete width of the casing section 14 to form the chamber indicated at 50 for receiving both air streams, that is, the positive air flow exiting from the exhaust pipe 32*b* of the vacuum pump, and the cooling air flow stream exiting from slots 44 within end cap 40*a* of the electric drive motor 36 driving the vacuum pump fan or blower. While the horizontal baffle plate 54 closes off the complete top of chamber 54, the vertical baffle plate 52 is provided with a circular opening as at 56 at one side of the machine which is of a given diameter and which permits entry of the air stream into the interior of the chamber 50. Air is permitted to exhaust from the expansion chamber 50 through any one or more of end wall 14*c*, bottom wall 14*a* or sidewall 14*d*, by way of multiple slots as at 57. For instance, as shown, a plurality of slots or circular holes 57 are provided within end wall 14*c* near the top of that wall to permit air to escape after expansion within chamber 50. The slots or holes 57 are provided at this location so as to be some distance above the floor F or underlying surface to be cleaned since the machine is operating as a wet vacuum extraction machine and there is always the possibility that the machine may be standing in water and that such water upon entering the machine would have a damaging effect on the electrical components. By eliminating any openings within the bottom wall 14*a* of the lower casing section 14 and providing cooling air inlet slots as at 45 and 46 within the casing section sidewalls 14*b*, also at a point well above the bottom of the casing section 14, water entry is practically eliminated. The unitary exhaust duct 48 is specially formed and specially configured to perform several functions. First of all, as may be seen in FIG. 2, in the plan view, the configuration of the exhaust duct is essentially of modified L-shape, while when viewed at its side, FIG. 1, the exhaust duct is shown as a bifurcated member or Y-shaped member. The exhaust duct 48 comprises a relatively large diameter tubular main duct portion 48*a* which is of circular cross-sectional configuration and having a diameter essentially equal to that of the diameter of the circular hole 56 within baffle plate 52, the main duct portion 48*a* being aligned with opening 56 and extending forwardly in the direction of the front of the machine in terms of control panel 27 and switch 28 controlling operation of the vacuum pump 36. The main duct portion 48*a* terminates in the reduced diameter portion 48*b*, still of circular diameter and defining with the exhaust pipe 32*b* of the vacuum pump casing 32 and a cylindrical sleeve 58, a venturi for the positive air stream discharging from the vacuum pump and passing from the scroll 32*a* through the exhaust duct main section 48*a* into the expansion chamber 50.

It is at the downstream end of the venturi indicated generally at 60, that a bifurcated branch duct portion 48*c* merges within main duct section 48*a*. The branch duct 48*c* is of generally elongated rectangular cross-section and inclines downwardly and forwardly toward the front of the machine and terminates in a cylindrical shroud 61 which is open at its upper end as at 61*a*, closed off at its lower end by means of a horizontal wall 61*b*, and which is of a somewhat larger diameter than the diameter of the motor casing 40 and end cap 40*a*, about which it lies. Thus, there is formed an annular cavity 63 between end cap 40*a* and shroud 60. As may be easily seen in FIG. 2, the motor cooling air exiting from the slots 44 within end cap 40*a* or at 68 passes about the periphery of the motor casing end cap and exit from the immediate area of the motor through the L-shaped branch duct 48*c* and enter into and mix with the main air stream, as indicated by arrow 70, for the main air stream, at the merge point for the duct sections or portions 48*b* and 48*c* downstream of venturi 60, the pump exhaust air entering the larger diameter exhaust duct portion 48*a* as evidenced by arrow 72.

As may be appreciated by reference to FIG. 2, the scroll portion 32*a* of the pump housing 32 causes the air sucked through the vacuum pump to increase in velocity as it reaches the restricted flow or venturi area provided by the exhaust pipe 32*b* integral with the scroll portion 32*a* of the pump casing. Further, downstream from the exhaust pipe 32*b*, the air in passing through main duct portion 48*b* expands into the larger diameter portion 48*a* where its velocity decreases to some extent. However, portion 48*b* of the exhaust duct 48 acts in conjunction with the exhaust pipe 32*b* form the venturi 60 to increase the velocity but reduce the pressure. This favorably influences aspiration of cooling air passing through the electric drive motor 36 into the pump exhaust. In that respect, the air enters the interior of the casing lower section 14 through slots 45 and 46 on opposite sides 14*b* thereof, as indicated by the arrows 64, the air passing through the interior of the casing as indicated by arrows 66 and entering into the cooling air inlet slots 42 for the motor casing 40. The cooling air exits from the cooling air exit slots 44 of motor end cap 40*a*, as indicated by arrows 68, where it is aspirated into the exhaust branch duct section 48*c* the high velocity low pressure area in the vicinity of venturi 60 as evidenced by arrows 70 for the cooling air flow stream within branch 48*c* of the exhaust duct and arrow 72 for the main air stream exiting from venturi 60. The combined air streams flow into the exhaust expansion chamber 54, as indicated by arrows 74. Finally, the air exhausts as at 78, from the expansion chamber 50 through slots or holes 57, FIGS. 1 and 2.

While the exhaust expansion chamber 50 does not include additional baffle members, such may be provided to provide a tortuous air flow path therein as the air is expanding, to further muffle the sound generated as a result of machine operation and air flow through the machine components for both the positive air stream created by the vacuum pump and the cooling air passing through motor 36. The components for the exhaust pipe 32*b* and sleeve 58 may be formed of plastic or metal. It is evidence from the above description that the noise level of the hot water vacuum extraction machine (or a like machine adapted for both hot water vacuum extraction and dry extraction operation) is reduced without causing any reduction in performance. The noise reduction is accomplished by mixing the vacuum pump exhaust air with the motor cooling air and letting it expand into an internal exhaust expansion chamber as at 54 within casing 12 before exhausting out of the casing as by way of slots or holes 57.

In an exemplary machine, a reduction in noise was effected in terms of ten decibels, from 83 decibels to 73 decibels. (Readings were taken with A weighting and slow response, six feet from the machine.)

Further, any water or debris sucked incidentally through the motor 36 will not be blown directly onto the carpet (or floor F) but will accumulate within expansion chamber 50.

Secondly, by reducing the velocity of the exhaust air prior to its leaving casing 12, this minimizes the kicking up of dust and the like in the vicinity of the hot water vacuum extraction machine.

Additionally, the utilization of a sealed bottom 14*a* for casing lower section 14 provides the added protection against shock in case of accidental placement of the unit in standing water up to approximately six inches, that is, the level of the slots or holes 45, 46 and 57 within casing section 14.

While the invention has been particularly shown and described with reference to a preferred embodiment thereof, it will be understood by those skilled in the art that various changes in form and details may be made therein without departing from the spirit and scope of the invention.

What is claimed is:

1. In a hot water vacuum extraction machine including:

an imperforate casing, a dump bracket mounted to said casing, a vacuum pump assembly fixedly carried by said casing and underlying the dump bucket, said vacuum pump assembly including a pump casing defining a plenum chamber, a suction fan mounted for rotation within said vacuum pump casing, said plenum chamber including an air inlet in sealed fluid communication with the interior of said dump bucket, said vacuum pump assembly further including an electric motor driving said suction fan, said vacuum pump casing including a scroll on the discharge side of said suction fan and terminating in a tubular exhaust pipe extending tangentially from the suction pump casing, said motor including a cylindrical motor casing, cooling air inlet openings at one end of said housing, cooling air outlet openings within the other end of said motor casing, air inlet openings within said machine casing to permit cooling air to circulate through said air inlet and air outlet openings of said motor casing for cooling said motor, the improvement comprising a sound muffling and air expansion chamber within said casing and exhaust duct means coupled to said exhaust pipe and leading to the sound muffling and air expansion chamber, said duct means including means for channelling cooling air discharging from said cooling air outlet openings of said motor casing for aspiration by air discharge from the exhaust pipe into said sound muffling and air expansion chamber, and air outlet means within said machine casing and communicating to the interior of said sound muffling and air expansion chamber;

whereby, reduction in noise level of the machine is accomplished by mixing the exhaust air from the vacuum pump with the motor cooling air and expanding the same within the sound muffling and air expansion chamber prior to exhausting the air outwardly of said casing.

2. The hot water vacuum extraction machine as claimed in claim 1, wherein said exhast duct means comprises a main tubular duct having a relatively large diameter downstream portion leading to the sound muffling and air expansion chamber and a smaller diameter upstream portion connected to the exhaust pipe of said scroll section of said vacuum pump casing and defining a venturi therewith, and wherein said means for channelling air from said cooling air outlet opening within said motor casing comprises a branch duct opening at one end to the larger diameter portion of said cylindrical duct downstream of said venturi, such that said venturi creates an area of reduced pressure to insure aspiration of the motor cooling air into the air discharge stream emanating from said vacuum pump scroll section.

3. The hot water vacuum extraction machine as claimed in claim 2, wherein said main tubular exhaust duct comprises integrally, a large diameter circular cross-section duct portion downstream of said venturi, and a smaller diameter circular cross-section duct portion upstream of the merging area between said branch duct and said main duct, and wherein said branch duct is of elongated rectangular cross-section, and terminates at its upstream end in a cylindrical shroud of a diameter slightly larger than the diameter of the motor casing, fitted about the end of the motor casing and surrounding the air outlet openings within said motor casing such that low pressure, high velocity flow of the air discharging passing through the venturi, tends to significantly aspirate the cooling air and force it to flow through the motor casing, and through the exhaust duct into the sound muffling and air expansion chamber.

4. The hot water vacuum extraction machine as claimed in claim 3, wherein said machine casing is of general modified parallelepiped form and includes an upwardly open lower casing section and a downwardly open upper casing section fitted to each other, said lower section comprising a transverse vertical baffle plate extending across the interior of the lower casing section from one side to the other, a horizontal baffle plate extending across the top of the lower section, joined to the vertical baffle plate at one edge, along the top thereof, and forming with the bottom wall, an end wall and laterally spaced sidewalls of said lower casing section, said sound baffling and air expansion chamber, and wherein said vertical baffle plate includes a circular opening sized to the diameter of said large diameter, downstream end of said exhaust duct and in juxtaposition thereto such that the air exiting from said exhaust duct passes into said chamber and expands therein and wherein air outlet holes for said chamber are provided within said lower casing section at a level well above the bottom of the lower casing section to prevent electrical shock in case of accidental placement of the casing in standing water.

5. In a hot water vacuum extraction machine including:

an imperforate, generally parallelepiped casing, a recessed top wall for said imperforate casing, a cylindrical dump tank removably mounted within said recess and having its bottom wall flush with the recessed bottom wall of said imperforate casing, a cylindrical vacuum pump assembly fixedly mounted to the interior of said casing and underlying said dump bucket, said vacuum pump assembly including a cylindrical pump casing defining a plenum chamber and bearing a rotatable suction fan within said casing, said vacuum pump casing including a scroll portion terminating in a tangential tubular discharge pipe of reduced diameter with respect to the cross-sectional diameter of said scroll casing portion, said vacuum pump assembly including an electrical motor beneath said plenum chamber and said scroll and including a cylindrical motor casing, said electric motor operatively coupled to said suction fan for driving said fan in rotation and producing a vacuum pressure within said plenum chamber, means for sealably transmitting said vacuum pressure to said dump tank, cooling air inlet openings within said cylindrical motor casing adjacent said scroll pump casing section, cooling air outlet openings within said motor casing at the end of said motor casing remote from said plenum chamber, the improvement comprising:

means including horizontal and vertical baffle plates, defining an elongated enlarged sound muffling and air expansion chamber within said machine casing, and a unitary tubular exhaust duct comprising a bifurcated member including a main duct section having a large diameter portion remote from said tangential exhaust pipe leading from said scroll portion of said pump housing, and a smaller diameter portion proximate thereto, sized to the diameter of said exhaust pipe and being sealably connected thereto to form a venturi in the area of intersection of the exhaust pipe and the small diameter portion of said exhaust duct, and an exhaust duct branch having one end opening to the large diameter portion of said exhaust duct main branch, downstream of said venturi, said exhaust duct branch at the other end terminating in a cylindrical shroud surrounding said motor housing and being spaced radially thereof to form an annular passage for leading cooling air passing through said motor into said branch duct for aspiration into the main stream of air emanating from the exhaust pipe of the vacuum pump casing and passing through said exhaust duct, and wherein the large diameter end of said exhaust duct opens to the interior of the sound muffling and air expansion chamber, and openings within said machine casing to the interior of the air muffling and expansion chamber;

whereinby, noise reduction is accomplished by mixing the exhaust air with motor cooling air and letting it expand into the sound muffling and air expansion chamber prior to exhausting out of said casing through said casing openings.

* * * * *